US006796191B1

(12) United States Patent
Boyd

(10) Patent No.: US 6,796,191 B1
(45) Date of Patent: Sep. 28, 2004

(54) TORQUE SWIVEL AND METHOD OF USING SAME

(76) Inventor: Anthony R. Boyd, 2204 Turnberry Dr., Loreauville, IL (US) 70552

( * ) Notice: Subject to any disclaimer, the term of this patent is extended or adjusted under 35 U.S.C. 154(b) by 0 days.

(21) Appl. No.: 10/359,885

(22) Filed: Feb. 6, 2003

Related U.S. Application Data

(63) Continuation of application No. 09/938,017, filed on Aug. 23, 2001, which is a continuation-in-part of application No. 09/506,627, filed on Feb. 18, 2000.

(51) Int. Cl.[7] ..... G01L 3/02
(52) U.S. Cl. ..... 73/862.321
(58) Field of Search ..... 73/862.333, 152.43, 73/152.49, 152.59; 166/301; 175/40, 52, 45

(56) References Cited

U.S. PATENT DOCUMENTS 3,069,902 A * 12/1962 Crosby ..... 73/862.323
3,668,926 A * 6/1972 Bell ..... 73/862.195
3,855,857 A * 12/1974 Claycomb ..... 73/152.59
4,091,663 A * 5/1978 Lagasse et al. ..... 73/862.31
4,193,720 A * 3/1980 Machida ..... 173/81
4,235,021 A * 11/1980 Claycomb ..... 33/307
4,359,899 A * 11/1982 Claycomb ..... 73/152.48
4,515,011 A * 5/1985 Beimgraben ..... 73/152.48
4,660,656 A * 4/1987 Warren et al. ..... 175/26
4,665,995 A * 5/1987 Braithwaite et al. ..... 175/45
4,805,449 A * 2/1989 Das ..... 175/48
4,811,597 A * 3/1989 Hebel ..... 73/152.48
RE33,150 E * 1/1990 Boyd ..... 166/242.5
4,928,764 A * 5/1990 Roessler ..... 166/113
5,320,169 A * 6/1994 Delatorre ..... 166/113
5,806,609 A * 9/1998 Stock et al. ..... 173/205
5,996,712 A 12/1999 Boyd
6,244,345 B1 6/2001 Helms
6,439,325 B1 * 8/2002 Peters et al. ..... 175/325.5

* cited by examiner

*Primary Examiner*—Edward Lefkowitz
*Assistant Examiner*—Octavia Davis
(74) *Attorney, Agent, or Firm*—Domingue & Waddell, PLC

(57) ABSTRACT

A torque swivel apparatus. The apparatus includes an upper body assembly secured to the lower end of a locking swivel of the type used in wireline operations. The upper body would engage into a lower body, the lower body secured to the drill string at the rotary table. The upper body would provide a pair of milled out wedge portions for accommodating a pair of wedge members in the lower body to engage therein during coupling. The apparatus further includes a plurality of cylinders positioned into the upper body with a piston member secured within each cylinder, so that each of the four faces of the wedge portions of the upper body accommodates a pair of pistons in its wall. The outer face of each of the pistons would make contact with each of the four faces of the wedge members of the lower body when coupling has occurred. The inner face of each of the pistons would mate with a line having fluid, which when acted upon would register force against the piston. A method of measuring the torque in a drill string is also disclosed.

4 Claims, 6 Drawing Sheets

TORQUE SWIVEL AND METHOD OF USING SAME

CROSS-REFERENCE TO RELATED APPLICATIONS

This application is a continuation application of application Ser. No. 09/938,017 filed on 23 Aug. 2001, which was a Continuation-in-Part of parent patent application Ser. No. 09/506,627 filed 18 Feb. 2000.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The apparatus and method of the present invention relates to monitoring or measuring torque. More particularly, the apparatus and method of the present invention relates to a system for measuring the amount of torque between stationary and rotatable members, and more particular, through compression of members within the apparatus as torque is applied, for example, in measuring torque in a drill string, while undertaking various types of operations.

2. General Background of the Invention

In the drilling of oil wells, the drill string from time to time must be prevented from rotating so that either wireline work must be done, or additional sections of pipe added onto the string. Usually, it is important that the amount of torque on the drill string be known in order to conduct certain operations on the drill floor. In the present state of the art, the torque on a drill string is usually measured by tongs which are equipped with sensors or the like to measure the amount of torque on the string. This is quite common, and is important, for example when a section of drill pipe is being added to the string, so that one knows the precise amount of torque in order to insure the joint will not leak.

Recently there have been developed several systems which include swivels which can be locked and unlocked between an upper drive portion and the rig floor. For example, one system is disclosed in U.S. Pat. No. 5,996,712, entitled "Mechanical Locking Swivel Apparatus." This device allows for a manual coupling and uncoupling of the drill string from the upper drive system when one wishes to connect or disconnect. A second system is disclosed in U.S. Pat. No. 6,244,345 entitled "Lockable Swivel Apparatus and Method" which also allows for the coupling and uncoupling of the drill string from the upper drive system through the use of hydraulic fluid moving a mandrel within the apparatus when one wishes to connect or disconnect between the upper drive and the drill string. One problem which is derived with the use of either of these systems is that the systems both eliminate the use of tongs on the drill string when the string is uncoupled. That being the case, there is no precise way to measure the torque on the string when the locking swivel apparatus is in the locked position. Likewise, during a backoff job, there is a need to know the amount of torque which is being applied to the string in either direction so as to assure integrity of the job. Therefore, without the tong line, and because of the locking and unlocking swivels, there is a need for a method and a device to measure the torque when the locking and unlocking swivels are being used, since there are no tongs on the system.

BRIEF SUMMARY OF THE INVENTION

The apparatus and system of the present invention solves the problems in the art in a simple and straightforward manner. What is provided is a torque swivel system which includes a torque swivel apparatus positioned in the drill string above the rotary table between an upper drive assembly and a locking and unlocking swivel of the type used in wireline or other types of drilling/recovery operations. The torque swivel includes an upper body assembly which would engage to a top drive assembly or to a wireline entry tool, and a lower body assembly which would engage into the upper portion of a locking and unlocking swivel secured in the drill string at the rotary table. The upper assembly would provide a pair of milled out wedge portions for accommodating a pair of wedge members in the lower body assembly to engage therein during coupling. There would further be provided a plurality of hydraulic cylinders positioned into the upper body assembly, with a piston member secured within each cylinder, and extending out into the milled out wedge portions, so that each of the four faces of the wedge portions of the upper body assembly accommodates a pair of pistols in its wall. The outer face of each of the pistons would make contact with each of the four faces of the wedge members of the lower body assembly, when coupling has occurred. The inner face of each of the pistons would mate with a hydraulic line having hydraulic fluid, which when acted upon would register force against the piston. Therefore, when there is torque applied to the drill string in a first direction, the face of the lower body assembly would press against two pistons in each of two faces of the upper body assembly, and the amount of force on the fluid would register on a gauge as ft./lbs. Of torque. Likewise, if the torque was applied in the opposite direction, the force would register against the other two faces of the upper body assembly, and the ft./lbs. Of force would register.

In the broadest sense what is disclosed is a method of measuring torque between a first stationary member and a second member comprising the steps of placing a torque swivel between the first and second members; applying rotational force to the second member, so that the amount of torque applied to the second member is measured by the torque swivel.

In practical application, the method involves using the torque swivel apparatus to measure torque in a drill string which is rotated by an upper drive unit for various drilling operations on an oil rig, by providing a torque swivel below the upper drive unit; locking and unlocking the drill string from the torque swivel; and then measuring the amount of torque placed on the drill string as sensed by the torque swivel while the drill sting is locked to the torque swivel.

When engaged in a method of measuring torque in a drill string during drilling operations, one would provide an upper drive unit; then provide a locking and unlocking swivel below the upper drive unit; position a torque swivel between the upper drive unit and a locking and unlocking swivel; lock the locking and unlocking swivel; and then rotate the drill string below the torque swivel; and measure the torque applied to the drill string as rotational force is applied to the drill string.

Another embodiment of the method would be measuring torque in a drill string during wireline operations, by providing an upper drive unit; placing a side or top entry device below the drive unit; providing a torque swivel below the entry device; positioning a locking and unlocking swivel between the torque swivel and the drill string below; locking the locking and unlocking swivel; applying rotational force to the drill string below the torque swivel; and measuring the torque applied to the drill string be rotated.

Another embodiment of the method of measuring torque would be in a drill string during pipeline recovery operations, by providing an upper drive unit; providing a torque swivel below the upper drive unit; positioning a locking and unlocking swivel between the torque swivel and the drill string below; locking the locking and unlocking swivel; rotating the drill string below the torque swivel to effect pipe line recovery; and measuring the torque applied to the drill string during the process.

A yet additional embodiment of the method of measuring torque in a drill string to perform wireline operations, wherein the drill string includes a wireline access device, is providing a torque measuring swivel below the wireline access device; providing a means for locking and unlocking the drill string below the torque measuring device from the torque measuring device; and measuring the torque on the drill string when the drill string is locked to the torque measuring device and rotational force is applied to the drill string.

Therefore, it is a principal object of the present invention to provide an apparatus, method and system for measuring torque in a drill string without the use of tongs and in combination with any locking swivel apparatus.

It is a further object of the present invention to provide an apparatus positionable in the drill string above the rig floor which measures torque by force applied to hydraulically operated piston members within the apparatus.

It is a further object of the present invention to allow torque on a drill string to be measured in either direction without the use of tongs.

It is a further object of the present invention to provide a method of measuring torque in a drill string above the rig floor when rotational force is applied to the drill string during all drilling/recovery operations, including wireline, pipe recovery, or other operations by measuring the torque applied to the string with a torque swivel apparatus.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 8:
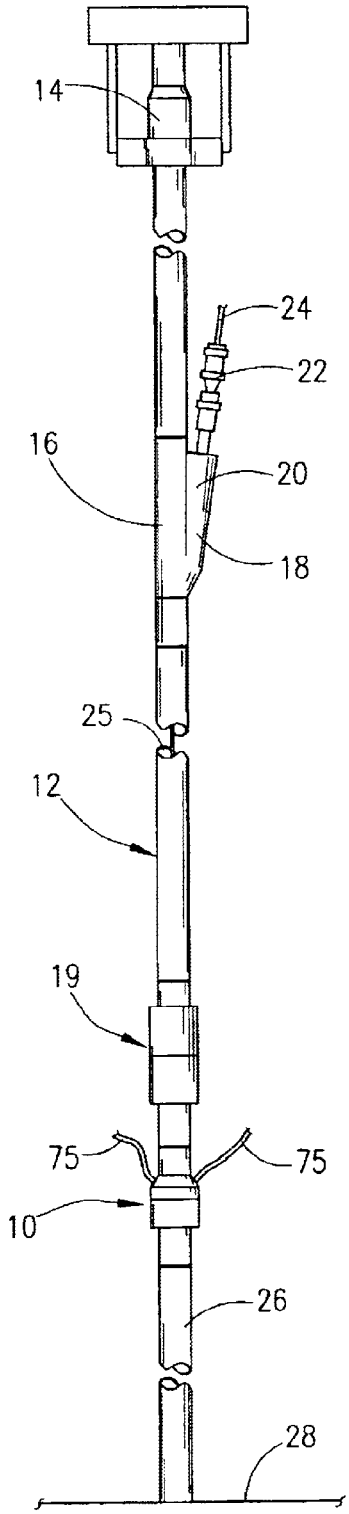
FIG. 8 illustrates an alternate embodiment of the present invention within a drill string where the torque swivel apparatus is placed between a locking and unlocking swivel and the rotary table.

FIGS. 1–7 illustrate the preferred embodiment of the apparatus of the present invention by the numeral 10, while FIG. 8 illustrates an alternate embodiment.

Figure 1:
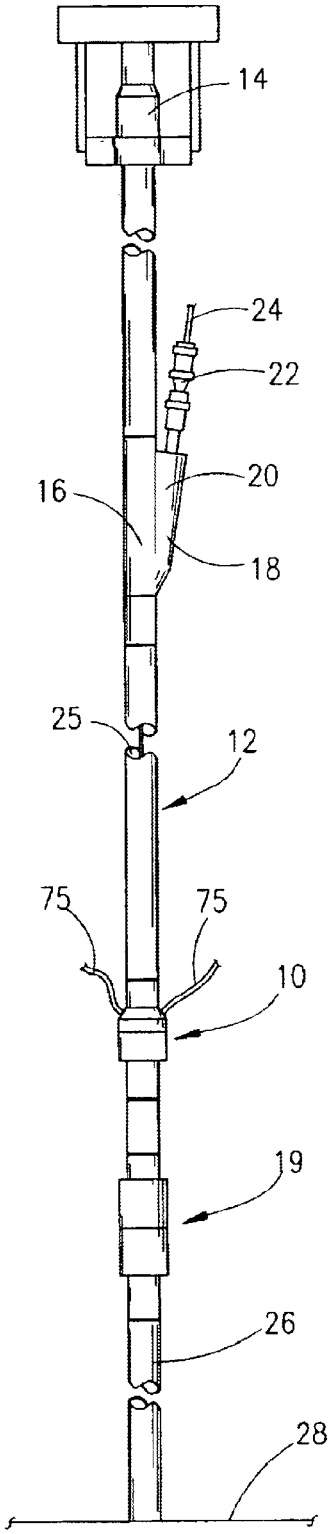
FIG. 1 illustrates an overall view of the preferred embodiment of the present invention within a drill string positioned between an upper drive unit and a locking and unlocking swivel.

As illustrated in overall view in FIG. 1, there is illustrated the torque swivel apparatus 10 placed within a drill string 12, the drill string 12 as illustrated including an upper drive unit 14, a side entry sub apparatus 16, of the type that is claimed and disclosed in U.S. Pat. No. Re 33,150, owned by Boyd's Bit Service, Inc., which, as illustrated includes a principal body portion 18, and an angulated portion 20 having an upper fixture 22 for feeding a wireline 24, as seen in partial view, down through a bore in the assembly 22 and principal body 18, and down through the bore 25 in the drill string 12 as illustrated. The assembly 10, as illustrated, would be connected on its uppermost end to the lower end of the side entry sub apparatus 16 and on its lower end to a locking and unlocking swivel apparatus 19, of the type disclosed in U.S. Pat. No. 5,996,712, entitled "Mechanical Locking Swivel Apparatus," or of the type disclosed in U.S. Pat. No. 6,244,345, entitled "Lockable Swivel Apparatus and Method", or any other type of locking or swivel which has the capability of being locked and unlocked during operation. There are provided hydraulic lines 75 extending from the outer wall of assembly 10, the function as will be described further. The locking and unlocking swivel 19 would be connected on its lowermost end to a section of drill pipe 26, which is seen being moved into or out of the drill hole at the level of the rotary table 28. In this particular embodiment, although not illustrated, on the lower end of the drill string there would be included a drill bit which would be operated by a dynadrill apparatus which is commonly known in the industry, and most likely there would be included a bent sub unit adjacent the dynadrill so that the drill bit would be drilling in a directional orientation.

Figure 2:
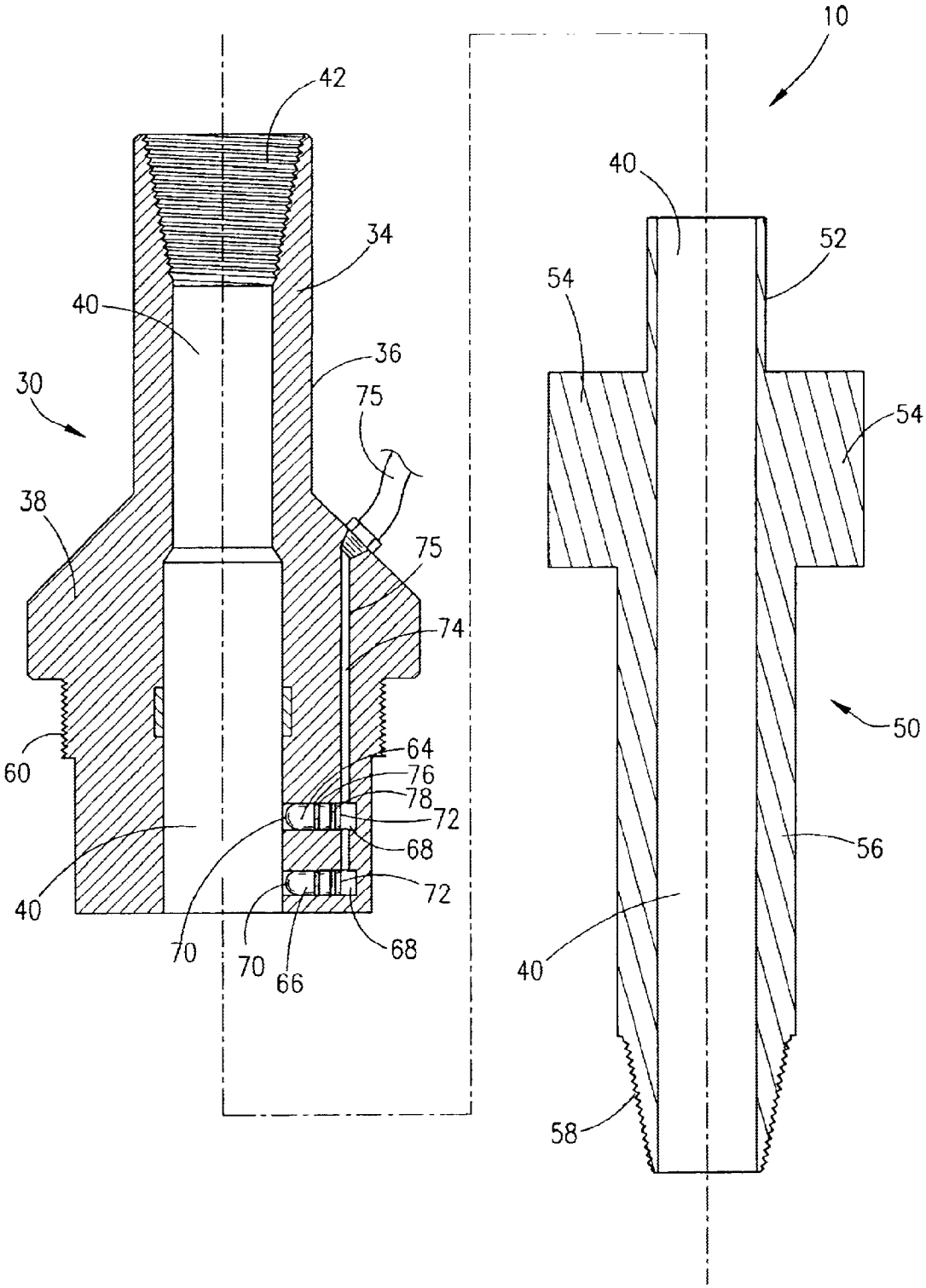
FIG. 2 illustrates an exploded cross-section view of the upper and lower body assemblies of the present invention.

For a detailed description of the present invention, reference is made to FIGS. 2 through 7. In FIG. 2 there is illustrated torque swivel assembly 10 in exploded view, the swivel 10 comprising an upper body assembly 30 and a lower body assembly 50. Upper body assembly 30 comprises an upper tubular portion 34 having an outer wall 36, which expands into the lower expanded body portion 38. There is provided a continuous bore 40 through the body assembly 30, with a female threaded coupling 42 on its upper end 34. Also illustrated in the lower body assembly 50 which includes an upper throat portion 52, and enlarged body portion 54, and an elongated lower body portion 56, having a male threaded end 58 for engaging to a drill pipe 26 (FIG. 1). Like upper body assembly 30, the lower body assembly 50 has a bore 40 therethrough in communication with bore 40 in the upper body assembly 30. Further, as seen in FIG. 2, The upper body assembly 30 includes outer threads 60 on its outer wall for accommodating a sleeve 62 (FIG. 3), when the two assemblies 30, 50 are coupled together as will be discussed further. Also, as seen in FIG. 2, there is illustrated a pair of pistons 64, 66 within a pair of cylinders 68 bored in the wall of upper body 30, the outer ends 70 of each of the pistons extending into the bore 40, and the inner face 72 of the pistons in communication with hydraulic fluid 74 in fluid line 75, as will be further described. For purposes of operation, each piston 64, 66, would have channels 76 along their walls for accommodating o-rings 78 therein, so as to prevent leaking of hydraulic fluid 74 from the line 75 during use.

Figure 3:
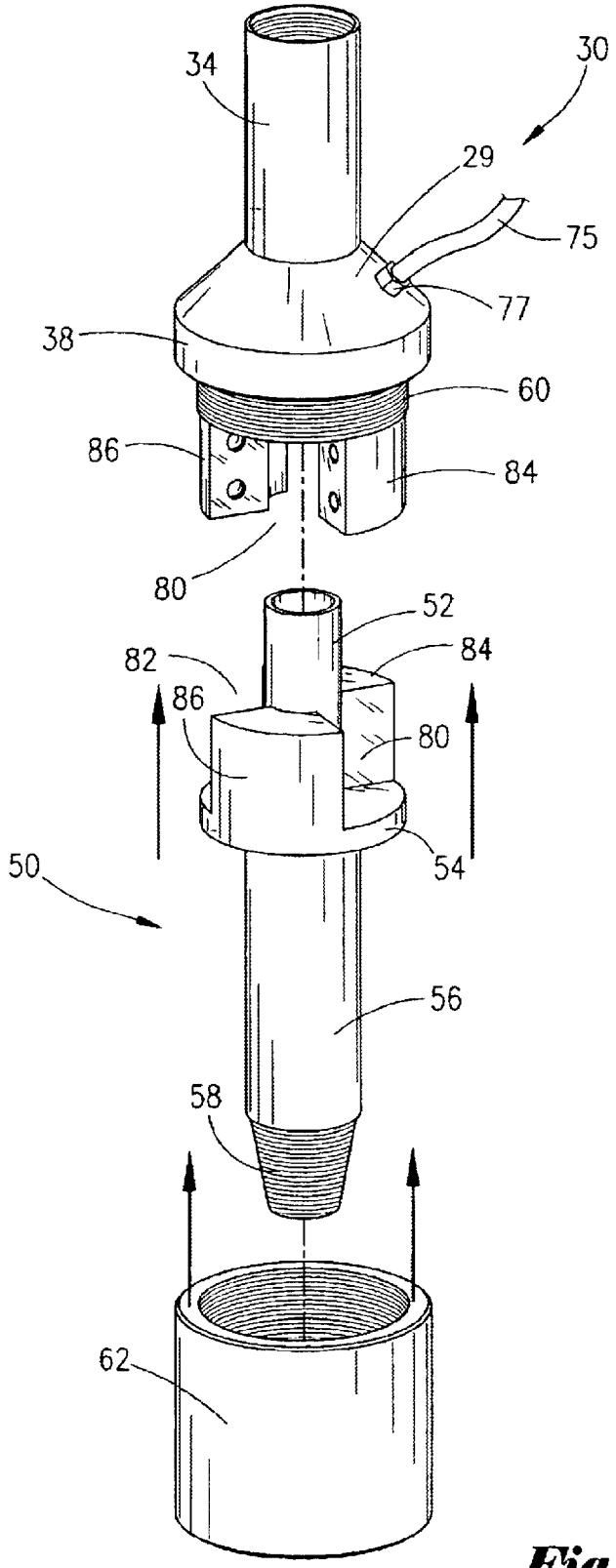
FIG. 3 illustrates the upper and lower body assemblies in the process of engaging.
Figure 7:
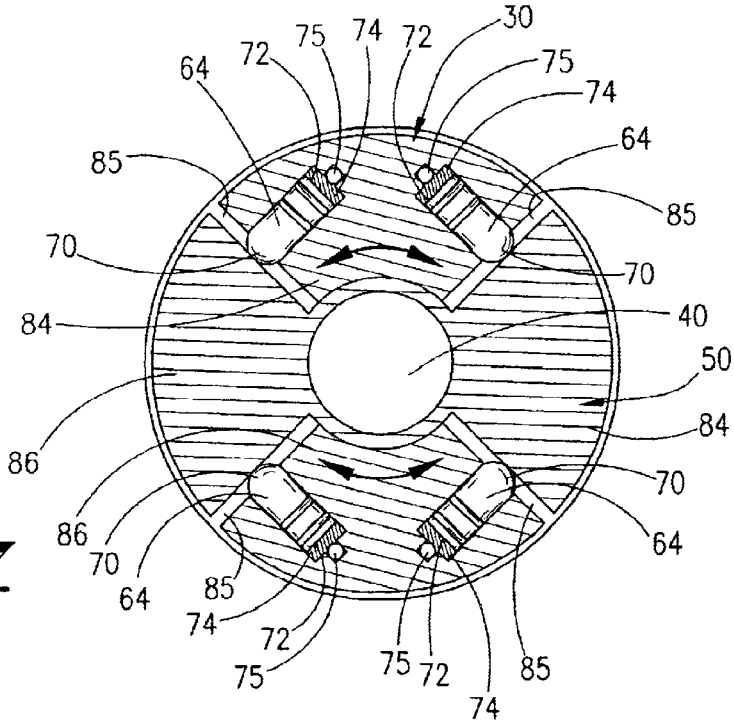
FIG. 7 illustrates a top cross section view of the upper and body assemblies engaging against the pistons to record torque values.

Turning now to FIG. 3, there is seen upper body assembly 30 ready to receive the lower body assembly 50 for coupling. There is also illustrated sleeve 62 which will be threadably engaged around the coupled assembly 10 via threads 60. As seen, the upper body assembly, and this may be seen more clearly in FIG. 7, includes a pair of wedge shaped portions 80, 82 milled out of its body, as does lower body assembly 50. As seen in FIG. 7, the wedge shaped portions 80, 82 are able to accommodate the resulting wedge members 84, 86 which remain when the wedge portions 80, 82 are formed. Likewise the upper end 52 of lower body assembly 50 engages within the central opening 59 formed by the wedges 84, 86 in upper body assembly 30. Therefore, the two body portions 30, 50 are able to couple so that the wedges mate easily. As seen in FIG. 7, the wedge portions 84, 86 formed in upper body 30 are of greater width than the wedge portions 84, 86 formed in lower body assembly 50. The reason for this is so that the pistons 64, 66 may be accommodated within the wedge portions 84, 86 of upper body assembly 30, while lower body assembly 50 has no pistons positioned therein.

Figure 4:
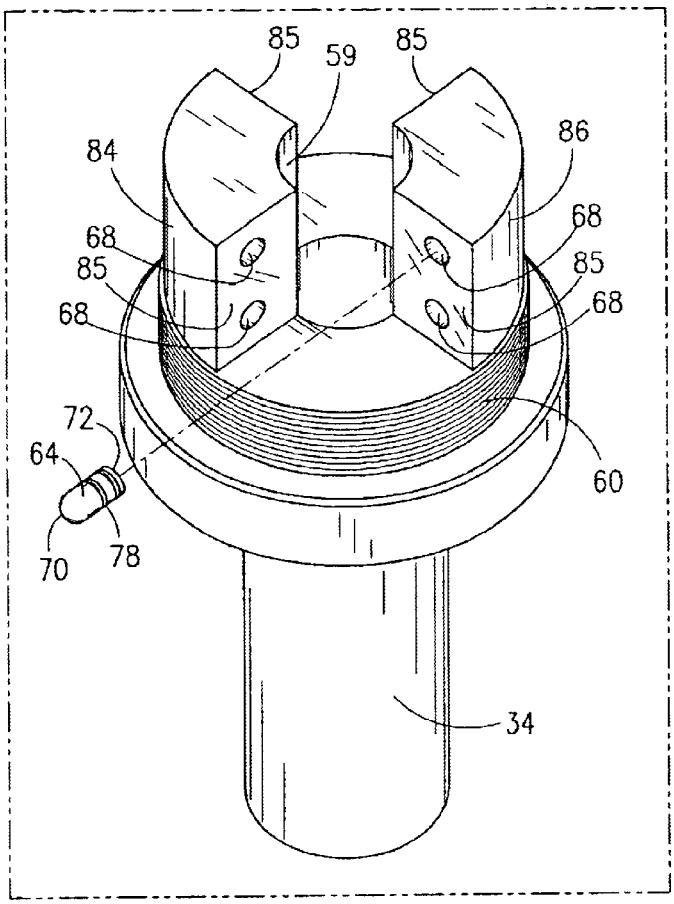
FIG. 4 illustrates the lower body assembly with a piston member being engaged into the body wall.
Figure 5:
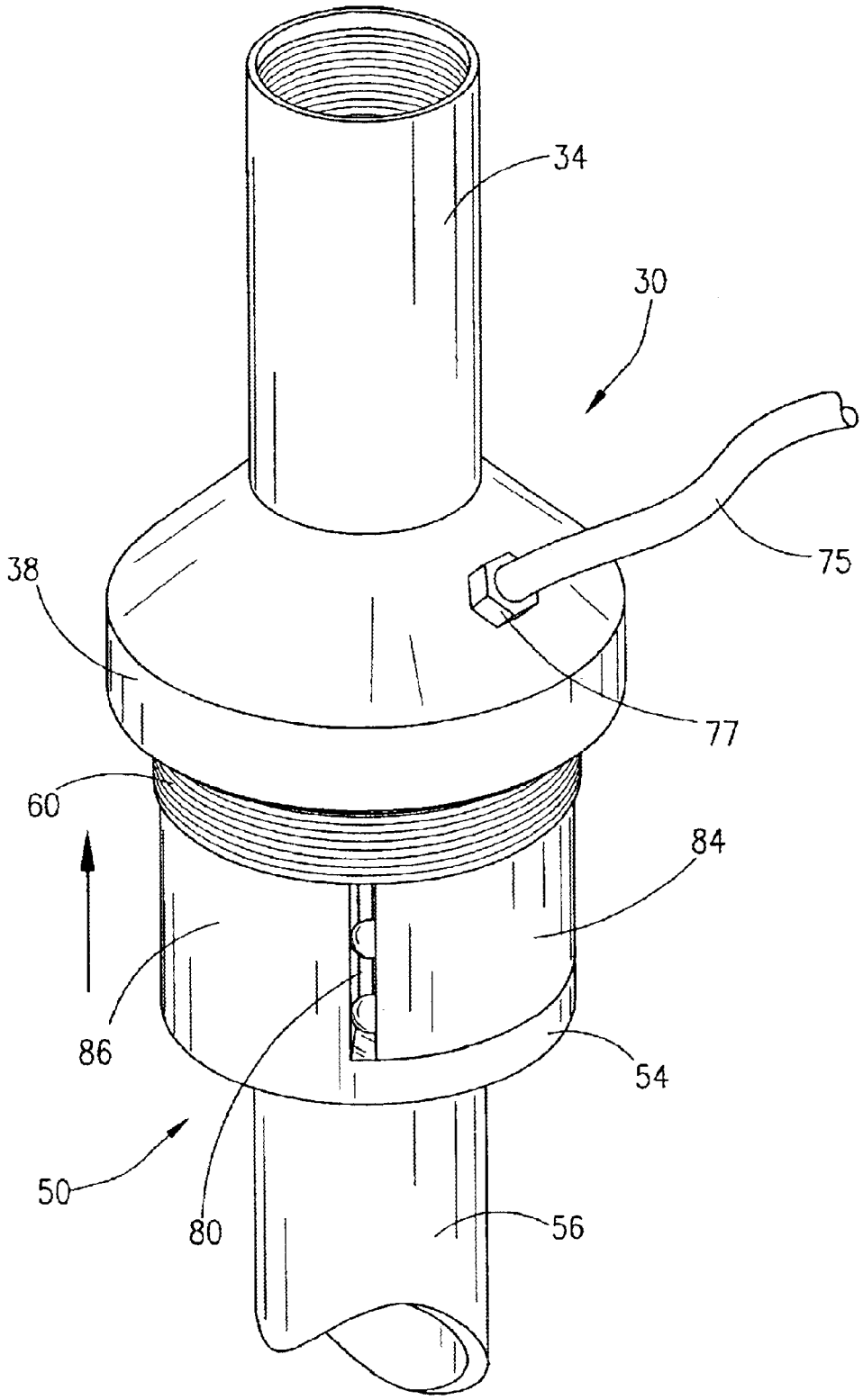
FIG. 5 illustrates the assemblies engaging with the pistons positioned against the face of the lower assembly.
Figure 6:
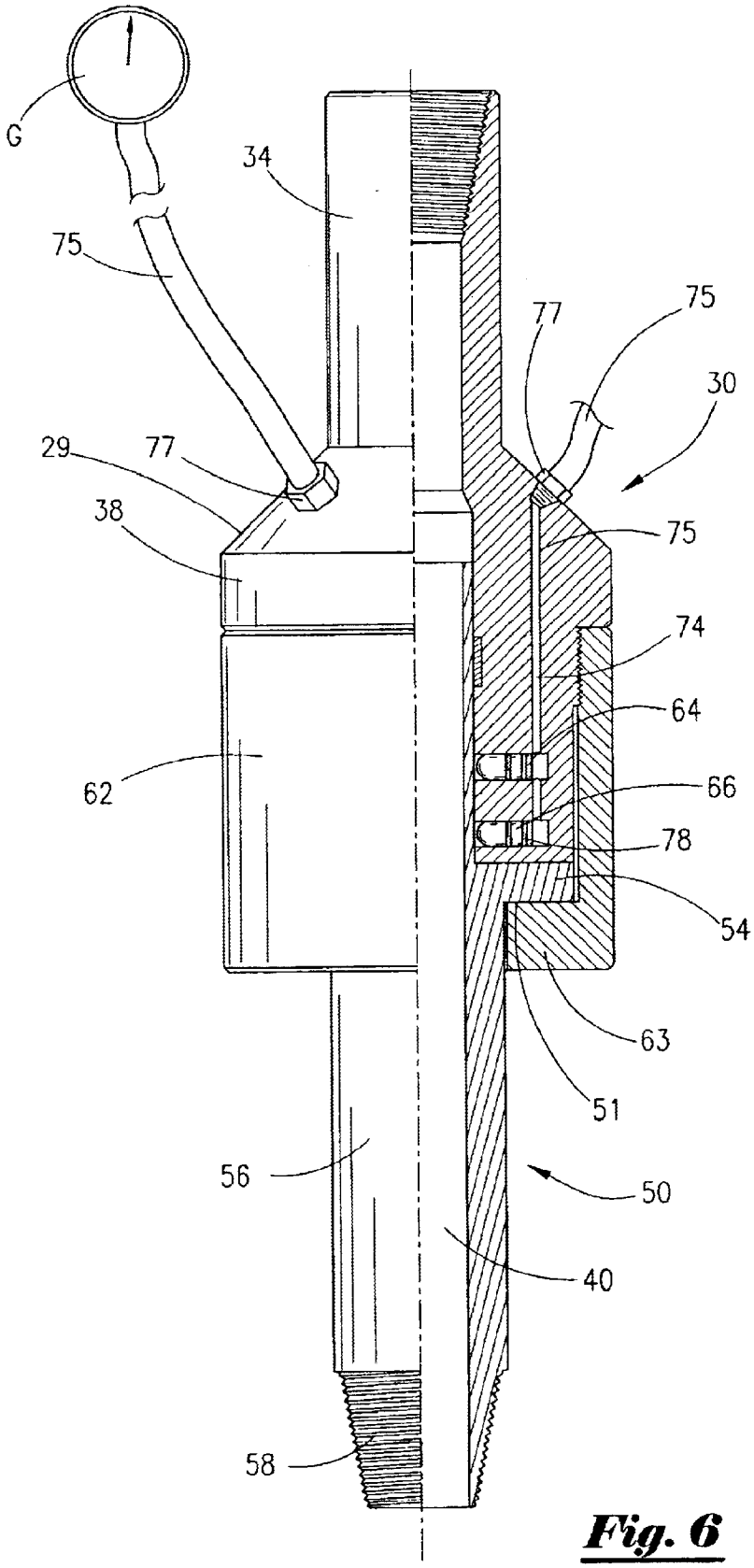
FIG. 6 illustrates a partial cutaway view of the apparatus of the present invention when the body assemblies are coupled together.

As seen in FIG. 4, the pistons 64, 66 are formed within cylinders 68 bored within the wall of body portion 30. As seen in FIGS. 4 and 7, each face 85 of each of the two wedges 84, 86 would accommodate a pair of pistons 64, 66, so that there are provided four pairs of pistons 64, 66, that is, a pair in each face 85 of the wedges 84, 86. As seen in FIGS. 5 through 7, when the body assemblies 30, 50 are coupled together the outer face 70 of each of the pistons 64, 66 make contact with each face 85 of each of the wedges 84, 86 of the lower body assembly 30, the reason as will be discussed further. Likewise, the inner face 72 of each piston 64,86 makes contact with hydraulic fluid 74 in line 75, which likewise terminates at connection 77 in the upper end 29 of upper body portion 30. This fluid line in operation, would then extend from the apparatus 10 and terminate at a gauge G to be read by an individual, so that ft./lbs. of torque would be registered on the gauge.

In FIG. 6 there is illustrated the apparatus 10 fully assembled. As illustrated, the upper body assembly 30 is engaged to the lower body assembly 50, with the wedge portions 84, 86 of each of the respective body assemblies mating adjacent one another. Further there is illustrated the piston members 64 engaged within cylinders 68, with hydraulic fluid 74 within fluid line 75. While fully engaged the sleeve member 62 has been secured to the threaded portion 60 of upper body assembly 30. It this manner, the two body portions 30, 50 are engaged against one another, with the sleeve member maintaining their engagement with the lower shoulder 63 resting against the lower end 51 of lower body assembly 50.

In operation, reference is made to FIG. 7 in particular. In this figure, it is illustrated where the lower body 50 has been coupled to the upper body 30, with the wedges 84, 86 of the two respective body assemblies 30, 50 engaged together. As illustrated, the pistons 64, 66 are within the cylinder chambers 68, with fluid 74 within line 75. O-rings 78 are in place so that leakage does not occur out of fluid line 75. When the locking and swivel 19 below the torque swivel 10 is engaged or locked, torque is placed on the drill string 26 below torque swivel 10. When this occurs, the lower body assembly 50 is torqued and begins to rotate slightly so that two faces 85 of the wedge members 84, 86 of lower assembly 50 press against the outer face 70 of pistons 64, 66. When this occurs, the hydraulic fluid behind each piston 64, 66 is compressed and the amount of force is registered at the terminal end of the fluid line 75 in a gauge as ft./lbs. of torque. The fluid 75 would exit the body assembly, and the force registered could be read at a location away from the apparatus itself.

Likewise, if the drill string is rotated in the opposite direction, the rotation force would be present between the opposite faces of lower assembly 50 against the opposite pistons 64, 66, again with torque in ft./lbs. being registered on the gauge. Therefore, despite the rotation direction of the string, the torque can be measured in either direction, without the use of tongs or the like.

In utilizing the torque swivel 10 in accomplishing the methods of the present invention, the torque swivel apparatus 10 would allow the connection of various wireline apparatus to be placed in a drill string between the top drive unit and a locking and unlocking swivel to measure torque. For example, if one were to be using the torque swivel in a wireline operation, one would simply follow the following steps: The torque swivel would be connected in a drill string wherein the swivel apparatus 10 would be located between the top drive unit 14 and the locking and unlocking swivel 19 which would then be connected to the rotary table 28. The locking and unlocking swivel 19 would be placed in the locked position, whereby torque is held on the drill string with the top drive unit 14, the drill string would be rotated so the torque would be moved down the drill string, and the torque swivel 10 would then record the amount of torque on the drill string as a measurement in ft. lbs. After this would be accomplished, the locking and unlocking swivel 19 would be unlocked, so that the drill string would then rotate once torque has been recorded. In utilizing the method for the purpose of recovering a pipe string, torque would be measured in the same manner when the torque swivel 10 is placed between the upper drive unit 14 and a locking and unlocking swivel 19. It is foreseen that a torque swivel 10 would be used in various other types of wireline operations wherein it is necessary that the amount of torque on the drill string be recorded by the swivel being engaged through a locking and unlocking swivel or simply to record torque of the drill string even if one were not utilizing the locking and unlocking swivel.

In FIG. 8, there is illustrated an alternate embodiment where the torque swivel 10 of the present invention positioned within the drill string above the rotary table 28 and below the locking and unlocking swivel 19, unlike the preferred embodiment where the swivel 10 is placed above the locking and unlocking swivel 19. This embodiment is not preferred as seen in FIG. 8, because should the swivel 19 unlock from the members below it, the rotary table may begin to rotate the string below the swivel 19 while the swivel 19 and the components above it remain stationary. Since the torque swivel 10 is below the locking and unlocking swivel 19, the swivel 10 would likewise rotate. Since the swivel 10 is being fed with hydraulic lines 75 for providing the necessary hydraulic fluid to be used in the swivel 10, as discussed in the specification, the lines would naturally become wrapped around the swivel as it rotates. This would not be desirable. However, in the event torque could be measured within the swivel 10 with other means, such as electronically or the like, and hydraulic fluid lines would not be necessary, it is foreseen that the torque swivel 10 could be placed in the configuration as illustrated in FIG. 8.

The foregoing embodiments are presented by way of example only; the scope of the present invention is to be limited only by the following claims.

What is claimed is:

1. A swivel apparatus for measuring torque, comprising:

a. an upper body secured to an assembly at its upper end;

b. a lower body secured to a work string at its lower end;

c. means for engaging the upper body to the lower body;

d. a first wedge member and a second wedge member provided between the upper body and lower body when the bodies are engaged to record the force of rotation when the lower body rotates against the stationary upper body in either direction, and wherein the first wedge member and the second wedge member include a plurality of pistons set within cylinders in each of four faces disposed on said first wedge member and said second wedge member.

2. The apparatus in claim 1, further comprising a hydraulic fluid line housing hydraulic fluid, the fluid line extending between inner faces of the pistons of said first wedge member and said second wedge member and terminating in a gauge for having the fluid in the line to register the force against the pistons in ft./lbs. of torque when the lower bodyrotates against the stationary upper body.

3. A method of measuring the torque in a drill string, comprising:

a. providing a swivel assembly having an upper body and a lower body, said swivel assembly being positioned between a swivel and a work string;

b. engaging said upper body to the swivel to remain stationary;

c. engaging said lower body to the work string which may rotate;

d. providing engagement between the upper and lower body of the assembly;

e. rotating the work string so that said lower body is rotated and the lower body applies force against the stationary upper body;

f. measuring the force in ft./lbs. of torque when the lower body is rotated in reaction to the drill string rotating.

4. The method of claim 3, wherein the upper body portion further includes a plurality of compressible pistons which are contracted when the lower body rotates, and wherein the step of measuring the force of torque includes contracting said pistons.

* * * * *